US005137336A

United States Patent [19]

Merten

[11] Patent Number: 5,137,336

[45] Date of Patent: Aug. 11, 1992

[54] PROCESS FOR THE AUTOMATED WINNING OF MINERAL, SUCH AS COAL, IN A LONGWALL WORKING

[75] Inventor: Gerhard Merten, Lunen, Fed. Rep. of Germany

[73] Assignee: Gerwerkschaft Eisenhutte Westfalia GmbH, Lunen, Fed. Rep. of Germany

[21] Appl. No.: 679,968

[22] Filed: Apr. 3, 1991

[30] Foreign Application Priority Data

May 6, 1990 [DE] Fed. Rep. of Germany ..... 4011091

[51] Int. Cl.[5] ..... E21D 23/14

[52] U.S. Cl. ..... 299/1.7; 299/32; 405/302

[58] Field of Search ..... 299/1.7, 11, 31, 32; 405/302

[56] References Cited

U.S. PATENT DOCUMENTS 3,285,015 11/1966 Carnegie ..... 405/302
4,887,935 12/1989 Koppers et al. ..... 405/291 X
4,957,327 9/1990 Oppenlander et al. ..... 299/11
4,964,675 10/1990 Welzel ..... 299/1

FOREIGN PATENT DOCUMENTS 2095725 10/1982 United Kingdom ..... 299/1

*Primary Examiner*—David J. Bagnell
*Attorney, Agent, or Firm*—Sughrue, Mion, Zinn, Macpeak and Seas

[57] ABSTRACT

A process for automatic ploughing during the winning of coal and the like in a longwall working with a hydraulic advancing lining with individual support units controlled by an electro-hydraulic control means. A plough guide is shifted automatically in stages by the plough cutting depth after passage of the plough by means of rams allocated to the support units and the support units are automatically shifted up as a function of the plough movement. The support units are positioned in support groups of which a plurality in each case are offset relative to one another in the shifting direction by the plough cutting depth and/or a multiple thereof. During the ploughing run only those support units of which the residual stroke of the shifting rams still available for shifting the plough guide is smaller than the plough cutting depth are automatically relocated in each case at a distance behind the passing plough. Break-in ploughing is preferably carried out simultaneously by the to-and-fro movement of the plough in the region of its end and reversal positions.

5 Claims, 3 Drawing Sheets

PROCESS FOR THE AUTOMATED WINNING OF MINERAL, SUCH AS COAL, IN A LONGWALL WORKING

FIELD OF THE INVENTION

The invention relates to a process for the automated winning of mineral, such as coal and the like, in a longwall working with a plough which is moved along the working face in alternate directions on a shiftable plough guide. In such an installation, an advancing support lining with individual support units controlled by electro-hydraulic control means is usually provided with hydraulic rams operable to advance the guide and to shift up the support units. The plough guide is automatically shifted in stages over sections of its length by a distance equivalent to the cutting depth of the plough by means of the hydraulic rams allocated to the support units after passage of the plough, and the support units are automatically shifted up as a function of the plough movement and the progress of working.

BACKGROUND TO THE INVENTION

It is known that the operating sequences in a longwall working, such as in particular the operating movement of the plough, the shifting of a scraper-chain conveyor carrying the plough guide and the displacement of the advancing supports, can all be controlled from a central control station. To achieve complete longwall control, which is a condition for automation of winning operations, the operating data which are relevant for this purpose, such as in particular the respective operating position of the plough, its cutting depth, the state of the face conveyor and of the plough guide in the longwall as well as the location of the advancing support units with respect to the working face and the face conveyor are determined and are fed to the control station. The control station can be equipped with a computer and with an operator's control terminal having a keypad for keying in a control program and with a screen for visual display of the respective face conditions. With electro-hydraulic support control means, there are allocated to the individual support units of the face, individual control devices which are connected to the central control station via data and command lines.

During the mechanical winning of the longwall, the support units which are arranged next to one another in a row behind the face conveyor are re-located individually in sequence after passage of the plough once the face conveyor has been moved forward. The known support control means selectively operate with individual control, sequence control and group order control. With automated winning the central control station carries out the staged shifting of the face conveyor and the shifting up of the advancing supports as a function of the operating movements of the plough.

During the ploughing of coal, ploughing in long strokes is aimed for to attain high outputs. Furthermore, it is generally desirable to keep the working face and therefore the longwall in a rectilinear course as far as possible. To enable the course of the working head in a winning longwall to be influenced with conveyor-bound supports controlled by a central station, it is known, for example, to detect the support and conveyor movements with sensors which are connected to the central station computer so that the respective actual conveyor line and the respective actual support line can be detected by means of the computer. The conveyor line and the support line thus form computer reference data lines during the shifting of the conveyor and during the following up of the supports. As the individual shifting rams are equipped with sensors for detecting the relative movement between the conveyor and the associated support units, deviations from a defined support line can be established and compensated by means of the computer via the determined actual reference lines (see U.S. Pat. No. 4887935).

A process for the electro-hydraulic control of plough and advancing support units in an automated longwall is also known in which the plough guided on the face conveyor operates with winning cuts extending substantially over the entire length of the longwall and in which, moreover, the support units linked to the conveyor with their rams can be moved forward in groups as a function of the measured extension lengths of the rams. The electro-hydraulic control means again comprises a central control station with a plough position display. The individual working steps in the longwall are controlled from the control station, to which all significant measured values from the longwall are transmitted. During each ploughing run, only one support group comprising several mutually adjacent support units of the entire support row along the longwall is shifted by the cutting depth of the plough or a multiple thereof (see U.S. Pat. No. 4964675).

Finally, for avoiding a machine stable which is to be excavated at the longwall ends, it is known to move the plough to and fro several times in the end region of the longwall in order to produce a "break-in" of the face, from which the plough can begin its winning operation (See DE-PS 18 09 713).

SUMMARY OF THE INVENTION

The main object of the invention is to carry out the process mentioned at the outset such that automated ploughing can be achieved with a high output while at the same time allowing for adequate support essential for roof care.

This object is achieved according to the invention in that the support units within the support row are offset from one another in a varying manner in the shifting direction sometimes by roughly the plough cutting depth and sometimes by an amount corresponding to a multiple of the plough cutting depth, and during the winning phases of the plough those support units of which the residual stroke available for the shifting of the plough guide is smaller than the plough cutting depth are automatically re-located in each case as a function of the respective plough location and of the residual stroke of the ram.

The process is preferably carried out such that, within the support row the support units are positioned in support groups each comprising at least three support units which are mutually offset in the shifting direction, with only that support unit of each support group, of which the ram residual stroke is smaller than the plough cutting depth, being automatically re-located in each case during the ploughing run at a distance behind the passing plough. The aforementioned support groups preferably comprise at least three and at most twelve, preferably four to eight, adjacent support units of the support row which are staggered relative to one another.

The staggered location of the support units in the longwall with varying offset distances, which corresponds to the plough cutting depth or a multiple thereof, and the re-location of the support units such that during each ploughing run only those support units are shifted, of which the rams have a residual stroke smaller than the plough cutting depth, has the result that, during ploughing in long strokes, that is during long head ploughing over the entire working head length, only a small proportion of the support units standing in the longwall are shifted in each case, namely a number of support units which corresponds substantially to the total number of support units standing in the longwall divided by the number of support units per group. The support units which are shifted during each ploughing run are distributed over the entire length of the longwall. This allows automated ploughing in long strokes under conditions which are desirable in terms of support, i.e. without excessive support lag and while avoiding undesirable damage to the roof. The control of the support advance sequences, as a function of the residual stroke, is carried out without difficulty and without excessive expenditure for control, by means of simple stroke measuring devices allocated to the rams. The relocation of the support units takes place during each ploughing phase at a distance behind the plough once the guide e.g. carried on a face conveyor, has previously been shifted in stages.

It goes without saying that the recovery of the advancing support as a function of the residual stroke proposed in the process according to the invention is such that, during continuous operation at a predetermined cutting depth of the plough, the strokes of the rams are measured and the measurements evaluated such that the support units are re-located only when the residual stroke of their rams in the advance direction is smaller than the plough cutting depth. The re-location of the support units is co-ordinated with the plough run and the shifting of the plough guide or of the face conveyor carrying or defining the plough guide. This can be carried out, for example, such that the shifting of the support units is initiated only when the plough has continued running by a predetermined number of support units, for example by at least five support units, in the direction of the opposing longwall end.

The process according to the invention preferably carried out in a manner such that the plough, on reaching its end and reversal positions, essentially without executing winning work, is driven back over a partial length of its plough path to an intermediate position, whereupon the plough guide is shifted over this partial length and the plough is then driven back with winning work to the relevant end or reversal position from which it is then driven without winning work to the intermediate position and then, while executing winning work, beyond the intermediate position in the direction of the other end or reversal position. With this mode of operation, therefore, the break-ins in the working face, which are necessary for ploughing work, are automatically produced at the end and reversal positions of the plough, generally located at the two longwall ends, so that the separate excavation and entrainment of a machine stable can be avoided and the plough need not be driven out into the gate road at the longwall ends. In the region between said intermediate positions, the plough guide can be shifted in stages at the predetermined distance behind the plough. Directly after the shifting of the plough guide, only that respective support unit from the individual support groups, of which the ram residual stroke is smaller than the plough cutting depth, is advanced.

The above-mentioned control, as a function of the residual stroke of the rams in the sense support shifting, preferably takes place via signal transmitters arranged in the plough path in conjunction a central control station of the electro-hydraulic control means detecting the respective plough locations. The signal transmitters arranged in the plough path, e.g. on the plough guide, can form correction sensors (synchronous switches) which correct the measured values which are delivered in the plough driving region of the plough path measuring device and contain measurement errors so that during ploughing the respective plough position is known at any time and the control devices, allocated to the individual support units, of the electro-hydraulic control means also receive the information via the respective plough positions so that shifting processes can be initiated exactly, as described above.

The invention may be understood more readily and various other aspects and features of the invention may become apparent from consideration of the following description.

BRIEF DESCRIPTION OF DRAWINGS

An embodiment of the invention will now described by way of example only, with reference to the accompanying drawings, wherein.

DESCRIPTION OF PREFERRED EMBODIMENT

Figure 1:
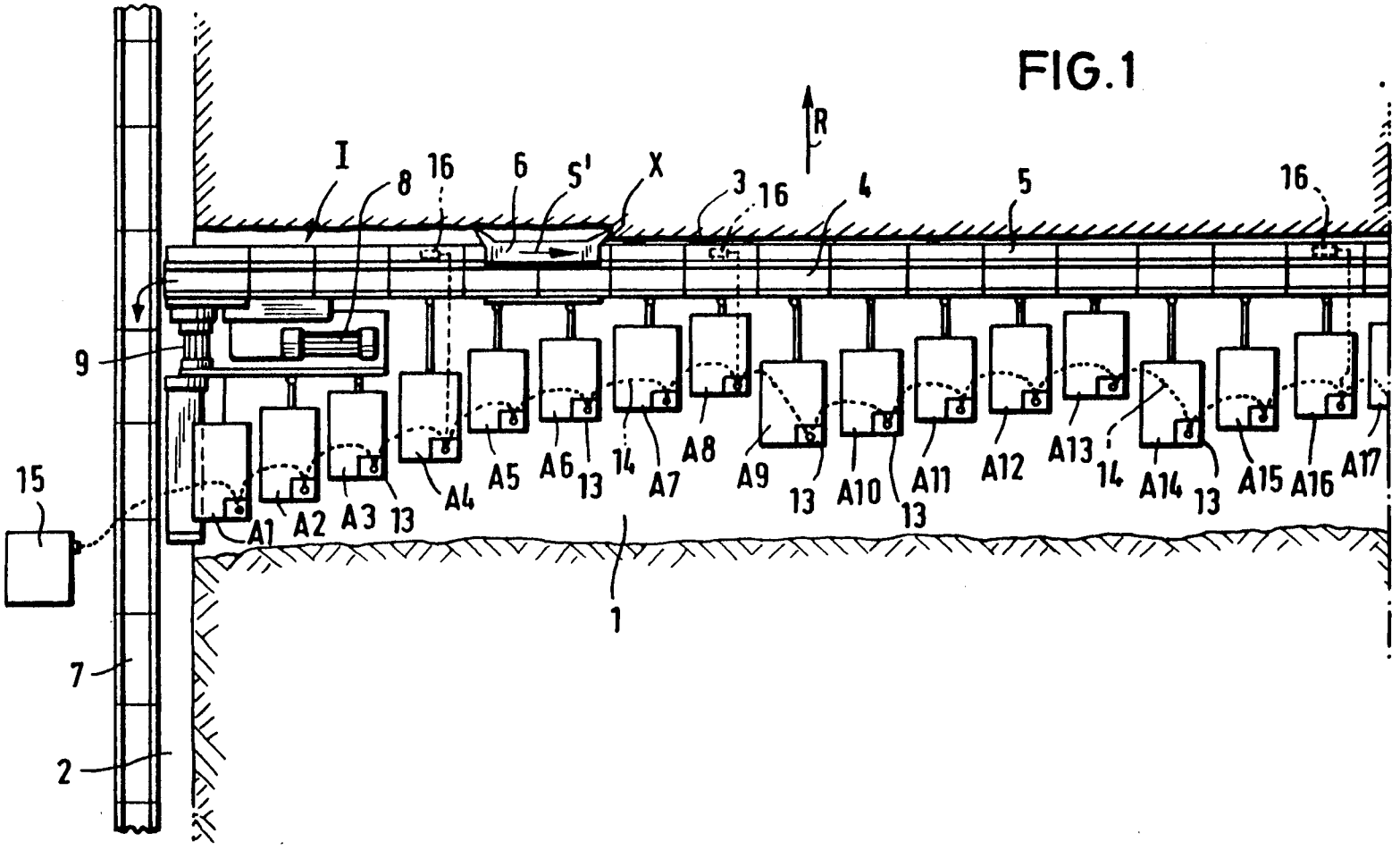
FIG. 1 is a schematic plan view of part of a longwall mining installation operating in accordance with the invention.

FIG. 1 is a schematic simplified representation of a partial length of a longwall working 1 together with its gate or access roadway 2. A mineral or coal face 3 extends from the gate road 2 forming the lower or foot gate road to the upper stope or head gate road (not shown). In front of the working face 3 in the longwall 1 there is a conveyor 4 which, as is normal, the form of a scraper chain conveyor which can be shifted up to the face 3 in stages. On the working face side of the conveyor 4 there is a plough guide 5 which is made up from sections on the pans of the conveyor 4. A chain-drawn plough 6 is guided for movement along the guide 5 to strip the coal from the working face 3. The thus won coal is loaded onto the conveyor 4. The conveyor 4 then transfers the coal from the longwall 1 to a gate or roadway conveyor 7 in the roadway 2. The drives of the conveyor 4 and of the plough 6 are located in the normal manner at the two ends of the conveyor 4. FIG. 1 shows only the so-called main driving station I with a conveyor drive 8 mounted on the goaf side of a machine frame on the conveyor 4 and a plough drive 9 also arranged on the goaf side.

Ploughing systems of the above-mentioned type, in which the plough 6 is positively guided on a guide 5 which is arranged on the working face side the face conveyor 4 and in which the plough driven runs in chain channels, and in which the plough guide 5 simultaneously limits the cut of the plough, are generally known.

On the goaf side of the conveyor 4 there is located the hydraulic advancing lining support of the longwall installation. The support consist of individual support units of identical construction, in particular support shields or support chocks, A1–A17 which are connected with hydraulic double-acting rams 10, to the pans of the conveyor 4 such that, on the one hand the conveyor 5 can be shifted and on the other hand the support units A1–A17 can be shifted by means of these rams 10. The rams 10 allocated to the individual support unit A1–A17 can also be integrated in advancing mechanisms guide rods and the like, as is known.

The support units A1–A17 preferably have cantilever advanced roof bars which can be extended toward the working face 3 from roof caps supported by hydraulic props, so that they can effectively temporarily support the roof in any location substantially up to the working face 3. The support units are numbered continuously, A1–A17 beginning from the longwall end located in the region of the gate road 2 to the other longwall end (not shown). The end most support units A1, A2 and A3 are allocated to the main driving station I of the conveying and ploughing system and are set back relative to the next adjacent support units A4–A8 which are connected with their rams 10 on the conveyor pans of the conveyor 4. The support units A4–A8 are staggered relative to one another by the plough cutting depth. The support units A4–A8, A9–A13, A14–A17 are arranged in support groups which each comprise a plurality of support units (five in this embodiment) which are offset relative to one another in the shifting and working direction R. The support units A4 to A8, A9 to A13, A14 to A17 etc. thus form a respective support group of which five support units are offset relative to one another in each case by the plough cutting depth X. In the basic position, the first support unit of each group in each case, that is the support unit A4, A9, A14 etc. is set back farthest from the face 3 and the conveyor 4 while the last support unit of each group, that is the support unit A8, A13, A18 (not shown) etc. is at the smallest distance from face 3 and the conveyor 4. This means that the rams 10 of those support units A8, A13, A18, etc. at the smallest distance from the conveyor 4 are virtually completed retracted while the rams 10 of the support units A4, A9, A14 etc. at the greatest distance from the conveyor 4 are extended so that the residual stroke still remaining in the pushing direction R is no longer sufficient to shift the conveyor 4 by the selected cutting depth X of the plough.

The shifting of the conveyor 4 with the plough guide 5 and the advancing support takes place as a function of the ploughing movement with the conveyor 4 and the plough guide 5 being shifted automatically in stages by the plough cutting depth by means of the rams 10 after the passage of the plough 6.

The operation stages can be inferred from FIG. 2 which merely shows that conveyor 4 without the mounted-on plough guide 5 together with the hydraulic rams 10 and the support units A4–A15 indicated in dot dash lines. The support units A1 to A3 allocated to the driving station I are omitted in FIG. 2 as these support units assume a separate location insofar as they are set back further with respect to all other support units owing to the overall dimensions of the driving station, but for convenience these are also staggered with respect to each other by the plough cutting depth X.

Figure 2A:
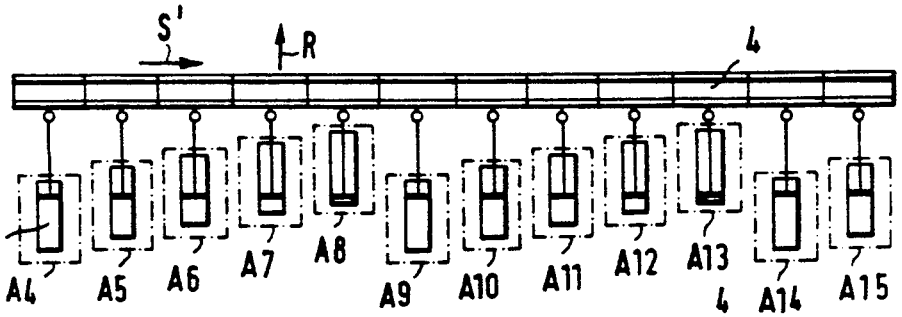
FIG. 2A to 2F are schematic plan views part of the installation showing successive stages of operation.
Figure 2B:
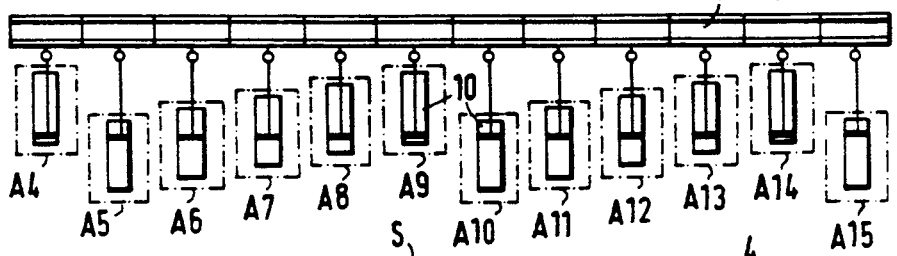
Figure 2C:
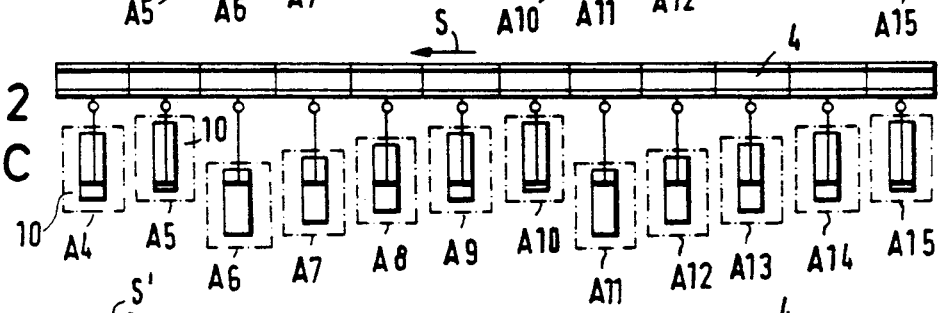
Figure 2D:
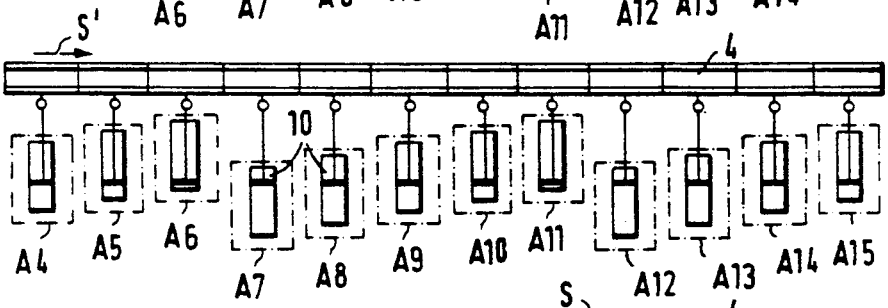
Figure 2E:
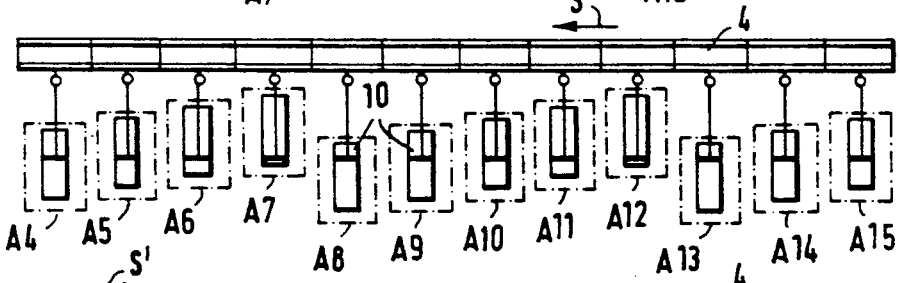
Figure 2F:
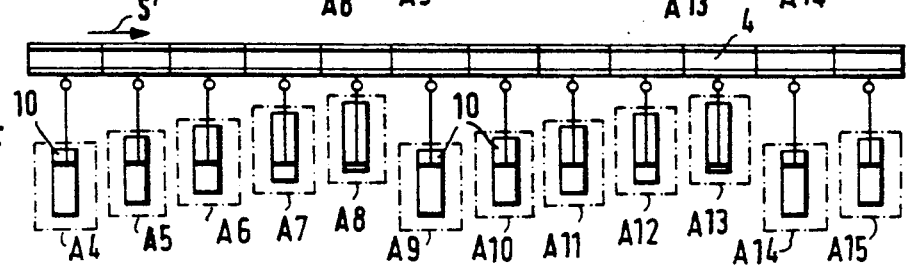

FIG. 2A shows the basic location of the support in the longwall, in which each support unit A4–A15 within each support group is offset in the shifting direction R by the plough cutting depth X relative to the preceding one. It is assumed that the plough 6 is located in the region of one longwall end, i.e. in the region of the support group A4 to A8 and, as also shown in FIG. 1, runs along the working face 3 in the direction of the arrow S' to work the face 3 by the predetermined cutting depth X. After passage of the plough 6, i.e. at a predetermined distance behind the plough which comprises, for example, the region of at least four to five support units, the conveyor 4 is pushed by the plough cutting depth X toward the working face 3. As the rams 10 of those support units A4, A9, A14 etc. at the greatest distance from the face conveyor 4 only have a residual stroke in the pushing direction R which is smaller than the plough cutting depth X, these support units A4, A9, A14 etc. are initially shifted, after passage of the plough 6, by pressure feed of the annular chambers of their cylinders toward the face conveyor 4 by a complete step length corresponding substantially to five times the plough cutting depth, as shown in FIG. 2B. During the ploughing run from one (left-hand) longwall end to the other (right-hand) longwall end in the direction of the arrow S', only a single support unit of each support group, namely the above-mentioned support units A4, A9, A14 at the greatest distance from the conveyor 4 are consequently shifted while all other support units remain stationary. At the same time, the conveyor 4 with the plough guide 5 is shifted in stages by the cutting depth X after the passage of the plough 6 at a predetermined distance behind the plough 6. This state is shown in FIG. 2B.

During the next ploughing run, the plough 6 moves in the direction of the arrow S from the right-hand longwall end to the left-hand longwall end. Those support units A15, A10 and A5 are the greatest distance from the conveyor 4 are similarly shifted at the predetermined distance behind the plough 6 by the complete advance path toward the conveyor 4, whereupon the conveyor 4 is shifted by extension of the rams 10 again by the plough cutting depth X in the direction of the arrow R. The situation shown in FIG. 2C then arises. During the next ploughing run in the direction of the arrow S', a similar procedure is adopted to that adopted in the preceding ploughing runs. The situation according to FIG. 2D then arises. The plough 6 then runs in the direction of the arrow S, the support units A7, A12 and the conveyor 4 being shifted similarly, giving rise to the situation according to FIG. 2E. During the subsequent ploughing run S', the situation shown in FIG. 2F and again corresponding to the starting situation according to FIG. 2A finally arises.

It can be seen that during each ploughing run in the direction of the arrows S and S' only a single support unit from each group is shifted, more specifically that support unit which is at the greatest distance from the conveyor 4 and of which the ram 10 has a residual stroke in the pushing direction R which is smaller than the ploughing stage depth. If each support group comprises adjacent support units, as shown in FIGS. 1 and 2, all support units of the longwall are shifted by the plough cutting depth after five ploughing runs.

Figures 3A, 3B, 3C, 3D, 3E:
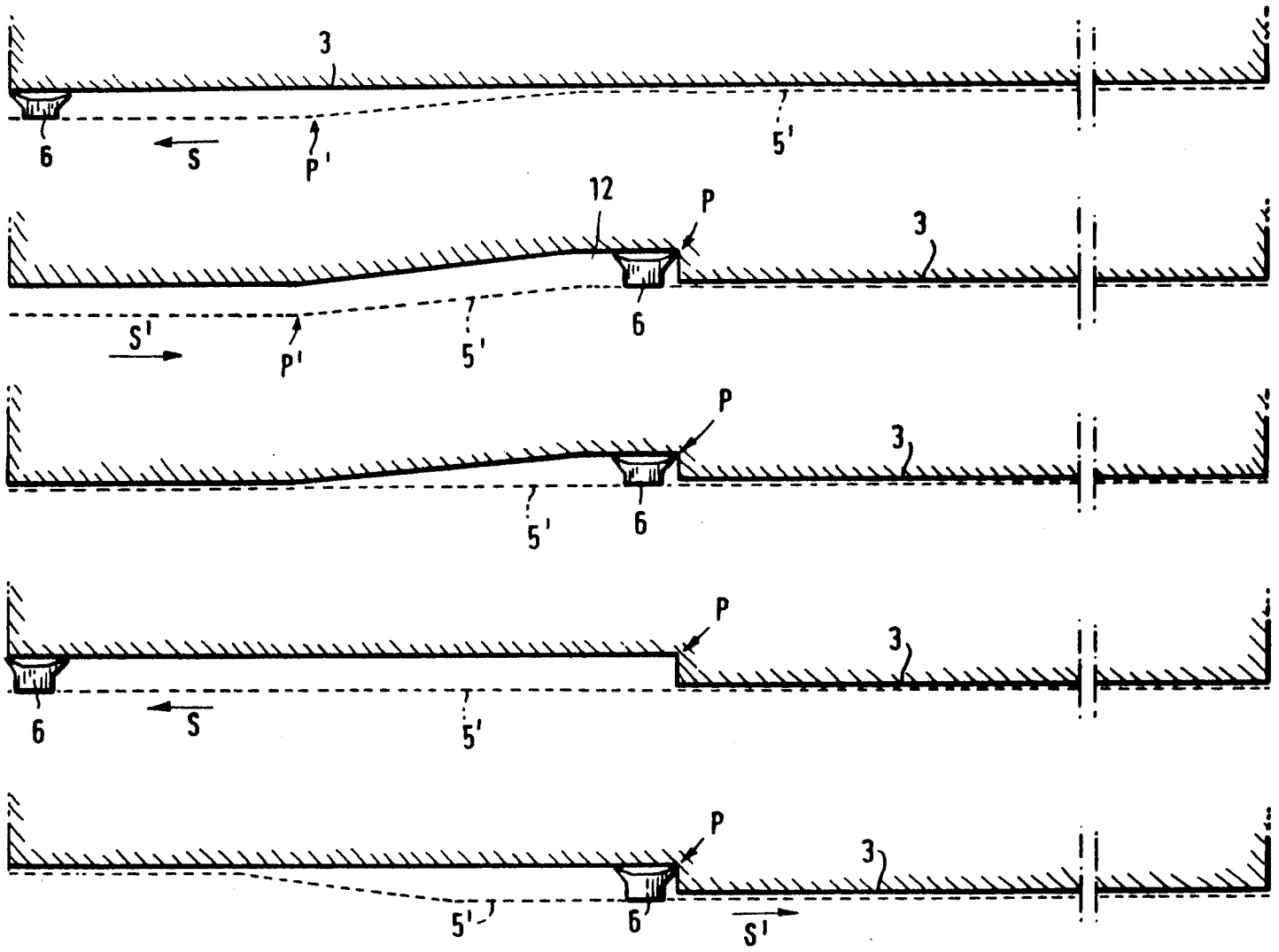
FIG. 3A to 3E are schematic plan views of part of the installation representing further stages of operation.

FIG. 3 depicts, in a schematic simplification, how a break-in can be produced in the working face 3 by the to-and-fro movement of the plough 6 in the region of the end and reversal positions of the plough 6, from which break-in the plough 6 can begin its winning run in the direction of the arrow S or S'. The working face side boundary of the plough guide 5 on which the plough 6 is led is designated by the broken line 5' in FIGS. 3A to 3D. FIG. 3A shows the plough 6 in one of its end and reversal positions in the region of the left-hand longwall end. During the winning run in the direction of the arrow S, the conveyor 4 together with the plough guide 5 has been shifted toward the working face 3 at a predetermined distance behind the plough 6. In the region which is smaller than the predetermined distance, the conveyor 4 is not yet shifted with the plough guide 5. This is the region between the left-hand end of the conveyor 4 and the plough guide 5, and the point P'. From the end and reversal position shown in FIG. 3A, the plough 6 then runs back over a partial length of its plough path in the direction of the arrow S' into an intermediate position P without carrying out winning work over the length region from the left-hand working face end to the point P'. Winning work is carried out over the relatively short portion between the points P' and P where the conveyor 4 with the plough guide 5 is located in the so-called S-curve, to produce the break-in denoted 12. The conveyor 4 with the plough guide 5 follows on the left-hand end portion at the latest when the plough 6 has reached the intermediate position P, as shown in FIG. 3C. The conveyor 4 and the plough guide 5 are now shifted towards the working face 3 over their entire length. From the intermediate position P according to FIG. 3C, the plough 6 runs, while carrying out winning work, in the direction of the arrow S into the left-hand end and reversal position, as shown in FIG. 3D. The plough 6 then runs according to FIG. 3E in the direction of the arrow S' to the intermediate position P and beyond this to the other longwall end and to the other end and reversal position where a break-in 12 can be produced in the face in a similar manner by to-and-fro movement of the plough. During the plough movement according to FIG. 3E, no winning work is carried out over the portion between the left-hand face end and the intermediate position P as the conveyor 4 with the plough guide 5 is shifted only behind the plough 6 running in the direction of the arrow S'. Over the longwall portion between the intermediate position P and the other (right-hand) end of the working face, on the other hand, winning work is carried out by the plough 6 to the predetermined cutting depth X.

All the above-mentioned plough movements can be controlled during automated operation. Similarly the processes during shifting of the face conveyor and the support units, these processes being co-ordinated with the plough movement. The automatic re-location of the support units A4–A17 takes place in the manner described during the ploughing operation as a function of the respective plough location in the longwall and as a function of the shifting ram 10 residual stroke such that, at a predetermined distance behind the plough 6, only those support units of which the residual stroke available for the shifting of the plough guide is smaller than the plough cutting depth are automatically relocated.

The shifting of the conveyor 4 and of the plough guide 5 and the re-location of the support units A4–A17 is effected by means of an electro-hydraulic control means. Control means of a known type can be used for this purpose, in particular those in which the electronic control devices 13 (FIG. 1) allocated to the individual support units A6–A17 are connected to one another via command and data lines 14 and to a central control station 15 to which the respective characteristic data of the longwall are fed. During ploughing, the respective site of the plough 6 in the longwall is determined by means of a plough path measuring device of a known type allocated to the plough drive and is fed to the central station 15 and the individual control devices 13 of the support units. It is advisable to arrange, on or in the plough guide 5, control sensors 16 which detect the passage of the plough 6 and correct the measurement data of the plough path measuring device. Synchronous switches or the like can be provided for these sensors. It is important that the information about the respectively correct plough site is present at the control devices 13 of the support units so that the control devices 13 can carry out the shifting of the conveyor 4 in addition to plough guidance and the relocation of the support units in the manner described. The shifting rams 10 are also provided with known stroke measuring devices which measure the piston strokes and re-locate the support units when the shifting ram residual stroke is smaller than the plough cutting depth X.

The central control station 15 preferably receives an operator's control terminal with a keypad by means of which ploughing can be influenced. If the plough cutting depth X is changed, the step width for the shifting of the conveyor 4 and of the plough guide 5 as well as of the support units can be adapted accordingly by suitable switch actuation. The apparatus can also be arranged such that a transition can be made selectively from the long head over the entire length of the working face to ploughing stages and vice versa. It is also advisable to construct the central control station 15 with a computer such that the number of support units of the support groups can be changed.

I claim:

1. In a process for automated ploughing of mineral in a longwall working with a plough which is moved along a working face in alternate directions on a shiftable plough guide, and with an advancing support lining with support units arranged in groups controlled by electro-hydraulic control means, wherein the plough guide is automatically shifted in stages by a distance commensurate with the cutting depth of the plough by means of hydraulic rams allocated to the support units after passage of the plough, and the support units are automatically shifted as a function of the plough movement and the progress of working; the improvement comprising: offsetting the support units within each group from one another in a varying manner in a shifting direction by one of approximately the plough cutting depth and an amount corresponding to a multiple of the plough cutting depth, and during winning runs of the plough, automatically relocating support units having a residual ram stroke available for the shifting of the plough guide smaller than the plough cutting depth as a function of the plough locating and the residual ram stroke.

2. Process according to claim 1, further comprising, arranging the support units in support groups each comprising at least three support units which are mutually offset in the shifting direction, and automatically relocating from each support group only a support unit having a residual ram stroke smaller than the plough cutting depth during a ploughing run at a distance behind the passing plough.

3. Process according to claim 1, further comprising: driving back the plough, on reaching an end and reversal position, essentially without executing winning work, over a partial length of a plough path to an intermediate position, shifting the plough guide over said partial length, driving the plough back with winning work to the end and reversal position, driving the plough without winning work to the intermediate position, and, while executing winning work, driving the plough beyond the intermediate position in the direction of another end and reversal position.

4. Process according to claim 3, further comprising: shifting the plough guide in stages at a predetermined distance behind the plough in a region between said intermediate positions, and from the individual support groups, shifting only a support unit having a residual ram stroke smaller than the plough cutting depth directly after the shifting of the plough guide.

5. Process according to claim 1, further comprising: controlling the rams as a function of the residual stroke in the sense of the shifting of the support via signal transmitters arranged in the plough path in conjunction with a central control station of the electrohydraulic control means detecting the plough location.

* * * * *